US010648204B2

(12) United States Patent
Cumbo et al.

(10) Patent No.: US 10,648,204 B2
(45) Date of Patent: May 12, 2020

(54) LATCH FOR A DOOR OF A MOTOR VEHICLE

(71) Applicant: Magna Closures S.p.A., Frazione Guasticce, Collesalvetti (IT)

(72) Inventors: Francesco Cumbo, Pisa (IT); Franco Giovanni Ottino, San Giuliano Terme (IT)

(73) Assignee: MAGNA CLOSURES S.P.A., Guasticce (Leghorn) (IT)

( * ) Notice: Subject to any disclaimer, the term of this patent is extended or adjusted under 35 U.S.C. 154(b) by 1009 days.

(21) Appl. No.: 15/024,388

(22) PCT Filed: Sep. 30, 2014

(86) PCT No.: PCT/EP2014/070992
§ 371 (c)(1),
(2) Date: Mar. 24, 2016

(87) PCT Pub. No.: WO2015/044463
PCT Pub. Date: Apr. 2, 2015

(65) Prior Publication Data

US 2016/0215536 A1 Jul. 28, 2016

(30) Foreign Application Priority Data

Sep. 30, 2013 (IT) ..... TO2013A0781

(51) Int. Cl.
*E05B 85/26* (2014.01)
*E05B 77/36* (2014.01)
(Continued)

(52) U.S. Cl.
CPC ..... *E05B 85/26* (2013.01); *E05B 77/36* (2013.01); *E05B 79/10* (2013.01); *E05B 85/243* (2013.01);
(Continued)

(58) Field of Classification Search
CPC ..... Y10T 292/1047; Y10S 292/23
See application file for complete search history.

(56) References Cited

U.S. PATENT DOCUMENTS 2,881,021 A * 4/1959 Jacobson ..... E05B 65/0046 292/216
3,347,584 A * 10/1967 Johnstone ..... E05B 47/0607 292/103
(Continued)

FOREIGN PATENT DOCUMENTS

DE 102009029023 A1 3/2011
EP 0406777 A1 1/1991
(Continued)

OTHER PUBLICATIONS

International Search Report dated Feb. 11, 2015 from International Patent Application Serial No. PCT/EP2014/070992.

*Primary Examiner* — Carlos Lugo
(74) *Attorney, Agent, or Firm* — Dickinson Wright PLLC

(57) ABSTRACT

A latch for a door of motor vehicle having a closing assembly adapted to cooperate with a latch striker comprising: a ratchet which can assume an opening position, in which ratchet enables engagement and disengagement between latch striker and a seat of ratchet, and a closing position, in which ratchet holds latch striker within seat; a first pawl rotatable about a first axis (B) and in a first rotation direction from a coupled position, in which it keeps, at least indirectly, ratchet in closing position and prevents disengagement of striker from seat, and a decoupled position, in which it permits the movement of ratchet from closing position to opening position; and a second pawl which cooperates with first pawl, cooperates with ratchet at least in a contact point (P) at least when ratchet is in closing position, and which is rotatable about a second axis (D) distinct from first axis (B).

16 Claims, 5 Drawing Sheets

(51) Int. Cl.
*E05B 79/10* (2014.01)
*E05B 85/24* (2014.01)

(52) U.S. Cl.
CPC ..... *Y10S 292/23* (2013.01); *Y10T 292/1047* (2015.04)

(56) References Cited

U.S. PATENT DOCUMENTS

| | | | | | |
|---|---|---|---|---|---|
| 4,172,768 | A | * | 10/1979 | Cerdan | E05B 85/26 292/216 |
| 4,203,621 | A | * | 5/1980 | Noel | E05B 85/26 292/216 |
| 4,627,649 | A | * | 12/1986 | Leplat | E05B 47/0657 292/216 |
| 5,092,639 | A | * | 3/1992 | Di Giusto | E05B 85/26 292/210 |
| 5,188,406 | A | * | 2/1993 | Sterzenbach | E05B 85/26 292/210 |
| 6,003,910 | A | * | 12/1999 | Dupont | E05B 81/14 292/201 |
| 2012/0313384 | A1 | * | 12/2012 | Cumbo | E05B 81/14 292/199 |

FOREIGN PATENT DOCUMENTS

| | | | |
|---|---|---|---|
| EP | 0496039 | A1 | 7/1992 |
| GB | 2409705 | A | 7/2005 |
| GB | 2433768 | A | 7/2007 |
| WO | WO2008061491 | A1 | 5/2008 |

* cited by examiner

LATCH FOR A DOOR OF A MOTOR VEHICLE

CROSS-REFERENCE TO RELATED APPLICATIONS

This application is a National Stage of International Application No. PCT/EP2014/070992, filed Sep. 30, 2014, which claims the benefit and priority of IT TO2013A000781 filed Sep. 30, 2013. The entire disclosures of each of the above applications are incorporated herein by reference.

TECHNICAL FIELD

The present invention relates a latch for a door of a motor vehicle.

In the following description and accompanying Claims, the term "door" is used broadly speaking to indicate any member movable between an open position and a closed position respectively opening and closing an access opening to an inner compartment of a vehicle, and therefore also includes boot and bonnet lids and rear hatches, in addition to the side doors of vehicles referred to in the description purely by way of example.

BACKGROUND ART

As is known, the vehicle doors normally comprise a frame-like top portion defining a window frame closed by a movable window when this is raised, a box-like bottom portion comprising an outer panel and an inner panel joined at one end by an end edge and defining in between a cavity normally housing the window, when this is lowered, and various component parts fixed to the panels, such as a latch and a window regulating device.

The known latch substantially comprises: a supporting body fixed to the vehicle door; striker fixed to a frame of the vehicle door; a closure assembly carried by the supporting body and adapted to releasably engage the striker integral with a fixed doorpost; and a release lever, which can be selectively activated to release the closure assembly from the striker.

More in detail, the closure assembly comprises: a ratchet which defines an open cylindrical seat; and a pawl. The ratchet is elastically loaded towards an opening position, in which the ratchet enables engagement and disengagement between the striker and the seat of the ratchet. Furthermore, the ratchet is rotatably movable between the opening position and a closing position, in which the ratchet holds the striker and prevents the disengagement of the striker from the closure assembly. The pawl is elastically loaded towards the ratchet for keeping the ratchet in the closing position and the pawl may be moved away from the ratchet by the release lever, so as to allow the ratchet to elastically return to the opening position.

In the known solution, the activation of the release lever results in a relative sliding movement between the pawl and the ratchet. The friction associated to that relative sliding movement renders considerably high the energy, which is required to disengage the striker from the ratchet.

Accordingly, in case of manual latches, the user is required to apply a considerable effort on a handle connected to the release lever, in order to release the striker from the ratchet.

In a completely analogous way, in case of power operated latches, it is necessary to supply the motor with a certain amount of energy, thus increasing the current absorption and the overall cost and size of the latch.

A need is therefore felt in the sector to reduce the energy required to release the striker from the ratchet.

Furthermore, the transition of the ratchet from the closing position to the opening position occurs at a very high speed and is substantially immediate.

As a result, the release of the striker from the ratchet generates an unpleasant noise, which is known in the field as "pop noise".

A need is therefore felt in the sector to reduce the noise associated with the fast release of the striker.

SUMMARY OF INVENTION

It is therefore an object of the present invention to provide a latch for a seat of a motor vehicle, designed to meet at least one of the aforementioned needs.

This object is achieved by a latch for a door of a motor vehicle having a closing assembly adapted to cooperate with a latch striker; the closing assembly comprising: a ratchet which can assume an opening position in which the ratchet enables engagement and disengagement between the latch striker and a seat of the ratchet, and a closing position in which the ratchet holds the latch striker within the seat; and a first pawl rotatable about a first axis (B) and in a first rotation direction from a coupled position in which it keeps, at least indirectly, the ratchet in the closing position and prevents disengagement of the striker from the seat and a decoupled position in which it permits the movement of the ratchet from the closing position to the opening position. The latch further comprising a second pawl which cooperates with the first pawl, cooperates with the ratchet at least in a contact point (P) at least when the ratchet is in the closing position, and which is rotatable about a second axis (D) distinct from the first axis (B) so that the second pawl may eccentrically rotate with respect to the first axis (B). The second pawl is rotatable about the second axis (D) from an initial position towards an intermediate position along a first stroke, and from the intermediate position towards a final position along a second stroke. The second pawl cooperating with the ratchet at least in the contact point (P), along the first stroke, so as to keep the ratchet in the closing position. The second pawl acting, along the second stroke, to leave the ratchet free to move from the closing position towards the opening position. The contact point (P) and the second axis (D) being joined by a line (L) along which the ratchet exerts a force (F) onto the second pawl along the first stroke. The line (L) being arranged relative to the first axis (B) in such a position that the force (F) generates an opening torque (T2) on the first pawl directed in the first rotation direction when the second pawl is in the intermediate position. The line (L) being characterized in that the distance of the line (L) from the first axis (B) increases, along an end portion of the first stroke, so that the force (F) generates onto the first pawl an increasing opening torque (T2) directed in the first rotation direction when the second pawl approaches the intermediate position.

The present invention also relates to a latch for a door of a motor vehicle having a closing assembly adapted to cooperate with a latch striker; the closing assembly comprising: a ratchet which can assume an opening position in which the ratchet enables engagement and disengagement between the latch striker and a seat of the ratchet, and a closing position in which the ratchet holds the latch striker within the seat; and a first pawl rotatable about a first axis (B) in a first rotation direction from: a coupled position in which it keeps, at least indirectly, the ratchet in the closing position and prevents disengagement of the striker from the seat, and a decoupled position in which it permits the movement of the ratchet from the closing position to the opening position. The latch further comprising: a second pawl which cooperates with the first pawl, cooperates with the ratchet at least in a contact point (P) at least when the ratchet is in the closing position, and which is rotatable about a second axis (D) that is distinct from the first axis (B) so that the second pawl eccentrically rotates with respect to the first axis (B). The second pawl includes a first surface which rolls on a second surface of the ratchet when the latter is in the closing position, and wherein the first surface is shaped as a portion of a cylindrical surface which is coaxial with the second axis (D).

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 6:
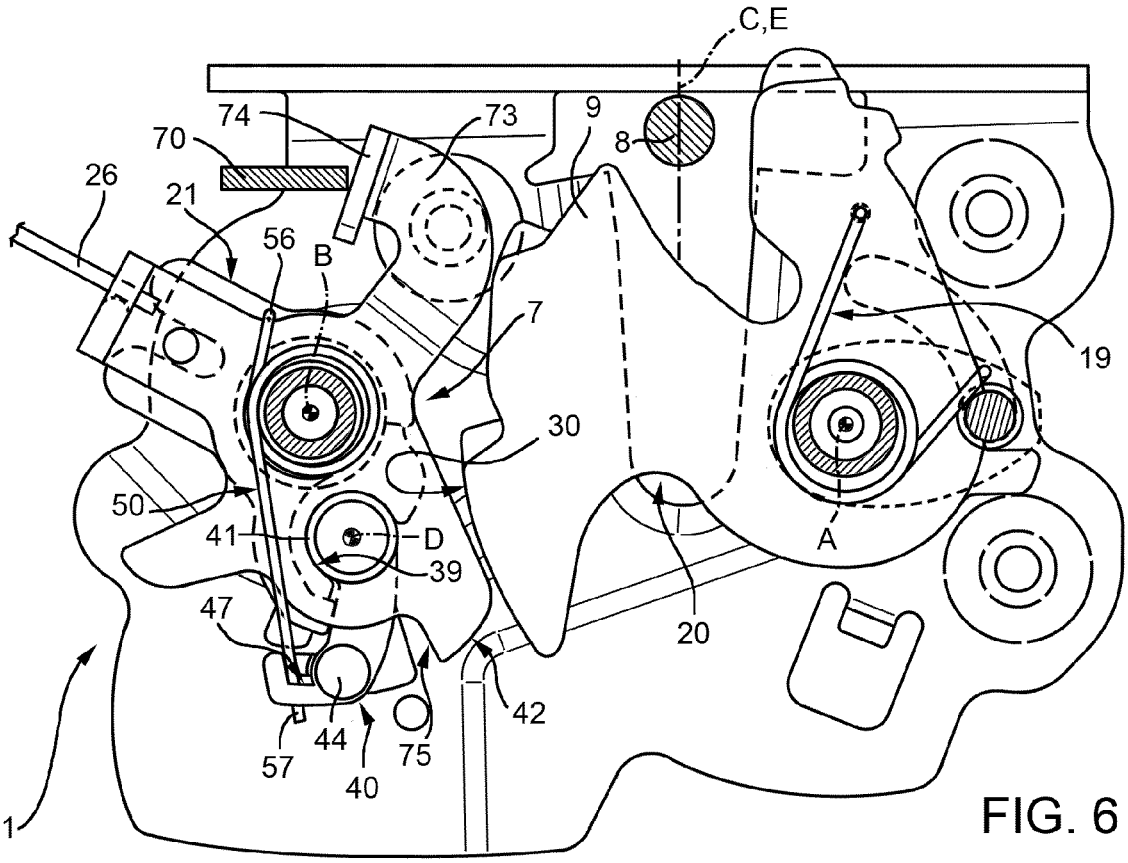
Figure 7:
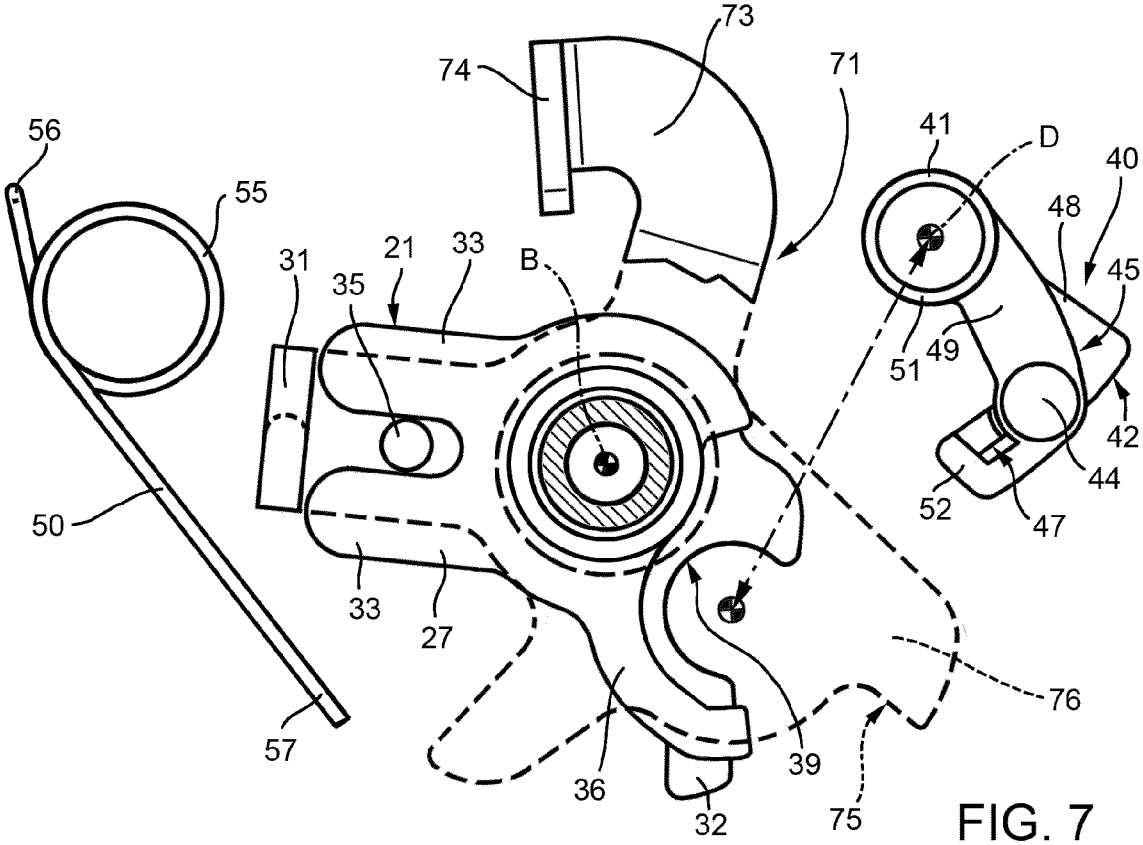
FIG. 7 is an exploded view of the latch of Figures FIGS. 1 to 6, with parts removed for clarity.
Figure 8:
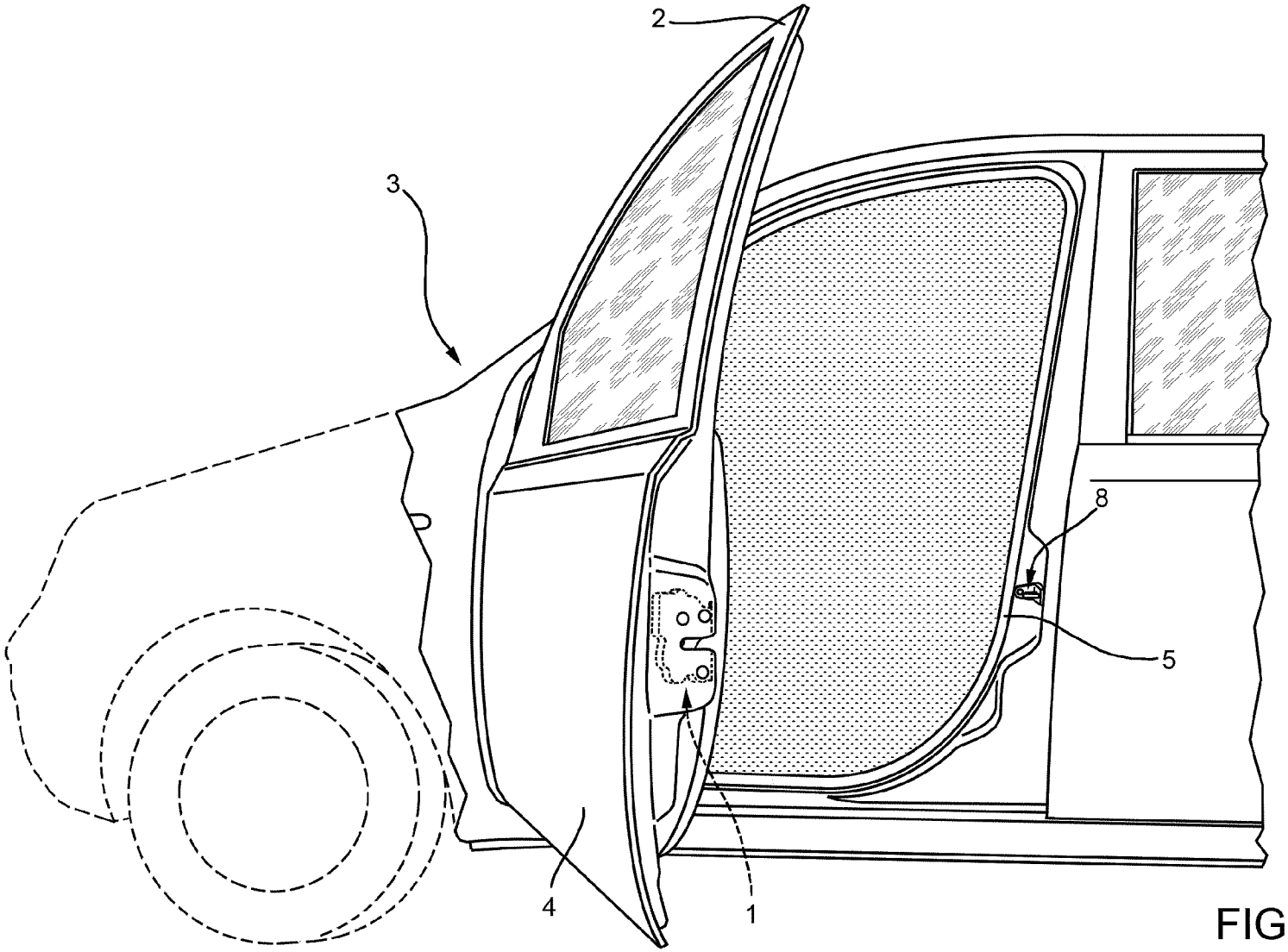
FIG. 8 is a schematic view if a door of a motor-vehicle with the latch of FIGS. 1 to 7.

Number 1 FIGS. 1 to 8 indicates a latch 1 for a door 2 of a motor vehicle 3 (only partially shown in FIG. 8). Door 2 is movable between an open position and a closed position respectively opening and closing an access opening to an inner compartment of motor vehicle 3. Door 2 comprises a frame-like top portion defining a window frame closed by a movable window when this is raised; and a box-like bottom portion 4 comprising an outer panel and an inner panel joined at one end by an end edge and defining in between a cavity normally housing the window, when this is lowered, and various component parts fixed to the panels, such as a latch 1 and a window regulating device. Portion 4 also comprises, on a peripheral edge thereof, a seal 5 (FIG. 8), which is adapted to tight-fluidly seal the inner compartment of motor vehicle 2.

Latch 1 is adapted to lock door 2 to portion 4 in such a position in which door 2 elastically compress seal 5. In greater detail, latch 1 substantially comprises (FIGS. 2 to 7): a supporting body 11 fixed in known manner to door 2; a closure assembly 12 carried by supporting body 11 and adapted to releasable engage a striker 8 (shown in FIGS. 2 to 7) integrally carried to a fixed part of motor vehicle 1; and an opening assembly 13 which may operated by an user to disengage striker 8 from closure assembly 12. Furthermore, supporting body substantially comprises a hollow shell 14 (only partially shown in FIGS. 1 to 7), which houses the closure assembly 12. Shell 14 is shown only with reference to a plate 15 and a wall 16 projecting from plate 15 and substantially orthogonal to wall 16.

Closure assembly 12 comprises: a ratchet 20 hinged to plate 15 about an axis A orthogonal to the plane on which plate 15 lies; and an auxiliary pawl 21 hinged to plate 15 about an axis B orthogonal to the plane on which plate 15 lies, and parallel to and staggered from axis B. More precisely, ratchet 20 comprises a ratchet seat 17, U-shaped in the embodiment shown, bounded by a pair of teeth 22, 23 and configured for receiving striker 8. Furthermore, ratchet 20 is loaded by a spring 19 towards an opening position (not shown), in which ratchet seat 17 faces a direction C along which striker 8 may enter or exit ratchet seat 17. Spring 19 is interposed between plate 15 and ratchet 20 and is, in the embodiment shown, a spiral spring wound about axis A. In particular, spring 19 is wound about a pin 18 which extends about axis A. In the embodiment shown, direction C is orthogonal to axes A, B.

Under the action of striker 8 and as a result of the slamming of door 2, ratchet 20 rotates, when moving from the opening position to a closing position (FIG. 2) in a first rotation direction (clockwise with reference to FIGS. 1 to 7), about axis A. Ratchet 20 is also elastically loaded by seal 5 towards the opening position, when door 2 is in the closing position. In particular, seal 5 exerts on ratchet 20 an elastic force directed along direction E, coincident with direction C in the embodiment shown. That elastic force generates on ratchet 20 a torque in the first rotation direction about axis A. That torque elastically loads, together with the action of spring 19, ratchet 20 towards the opening position.

Ratchet 20 comprises: a main body 9 which defines teeth 22, 23 and ratchet seat 17; and an overmoulding 10. Tooth 23 is bounded by a curved front surface 30, which is orthogonal to axis A. Auxiliary pawl 21 is elastically loaded by a spring 26 towards a coupled position (FIG. 2), in which it keeps ratchet 20 in the closing position and prevents disengagement of striker 8 and ratchet seat 17. Furthermore, auxiliary pawl 21 may be rotated about axis B (FIGS. 2 to 7), under the action of opening assembly 13 and against the action of spring 26, in a decoupled position (FIG. 6), in which it permits the movement of ratchet 20 from the closing position and the opening position. Still more precisely, auxiliary pawl 21 is rotated by opening assembly 13 in the first rotation direction (clockwise with reference to FIGS. 2 to 7) from the coupled position to the decoupled position, as shown in the sequence depicted from FIGS. 2 to 6.

Auxiliary pawl 21 comprises (FIG. 7): a plate 27 hinged to plate 15 about axis B; a body 31 fitted to plate 27; and an overmoulding 32. Plate 27 defines, on one side of axis B, a pair of teeth 33 spaced from one another by a U-shaped seat 34, which is engaged by a pin upwardly protruding from body 31. Plate 27 also comprises, on the opposite side of teeth 33 with respect to axis B, a C-shaped arm 36. Overmoulding 32 occupies part of the cavity defined by arm 36.

Figure 5:
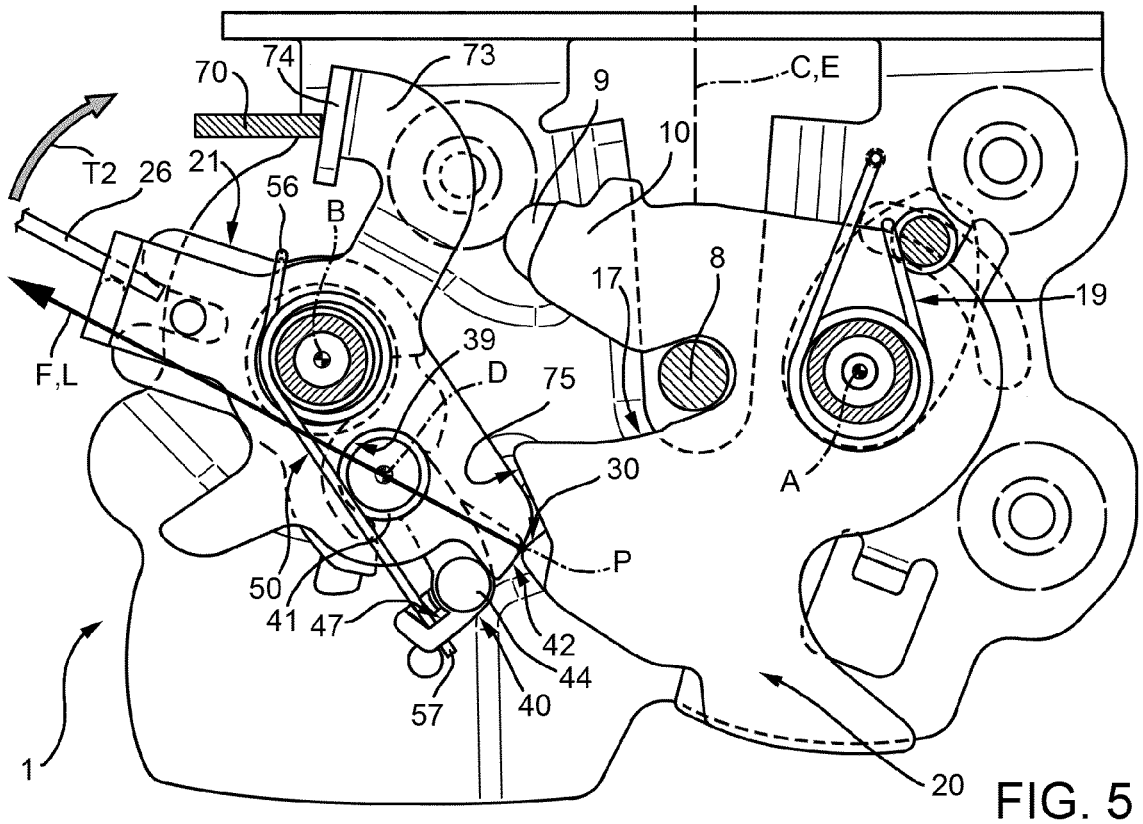

Advantageously, latch 1 comprises a pawl 40 which cooperates with auxiliary pawl 21, cooperates with ratchet 20 in a contact point P, and which may rotate about an axis D distinct from axis B, so that pawl 40 may eccentrically rotate with respect to axis B (FIGS. 2 to 7). In particular, auxiliary pawl 21 and pawl 40 cooperate with one another, in such a way that the rotation of auxiliary pawl 21 about axis B in the first rotation direction—clockwise in FIGS. 2 to 7—causes the eccentric rotation of pawl 40 about axis B in the same first rotation direction. In other words, pawl 40 is virtually hinged about axis D to auxiliary pawl 21, and contact point P rotates along an arch-shaped trajectory about axis D and eccentrically about axis B. Axis D is, in the embodiment shown, parallel to axis B. Pawls 21, 40 are also elastically connected to each other by a spring 50 (FIG. 7).

In greater detail, pawl 40 comprises: a cylindrical pin portion 41 which extends about axis B and engages a pawl seat 39 of auxiliary pawl 21 in a rotatably way about axis B and substantially without sliding contact; a surface 42, opposite to portion 41, which contacts surface 30 of ratchet 20 at contact point P, when pawl 21 is in the coupled position. Seat 39 is defined, in the embodiment shown, by overmoulding 32 of auxiliary pawl 21. Surface 42 extends orthogonally to axes A, B, D. In the embodiment shown, surface 42 is shaped as portion of a cylindrical surface of axis D.

Pawl 40 also comprises: a pin 44 which defines an abutting surface 45 for the opening assembly 13; and a protrusion 46 which protrudes from pin 44 on the opposite side of surface 45 and defines a slot 47. Pin 44 extends cylindrically about an axis parallel to and staggered from axis D. Protrusion 46 comprises a C-shaped arm 52 which integrally protrudes from pin 44, on the opposite side of surface 45, and which defines slot 47 together with pin 44.

In greater detail, pawl 40 is formed by a plate 48 and an arm 49 which is co-moulded over plate 48. Plate 48 and arm 49 extend radially to axis D. Plate 48 lies orthogonally to axis B and is substantially co-planar with plate 27 of auxiliary pawl 21 and body 9 of ratchet 20. Plate 48 is bounded by surface 42 on the opposite side of axis B and portion 41 integrally protrudes by plate 48. Arm 49 lies orthogonally to axis B and defines, at a first end thereof, a hollow cylindrical body 51 which houses portion 41. Furthermore, arm 49 defines, on the opposite side of body 51, protrusion 46 and slot 47. Spring 50 has, in the embodiment shown, a main spiral portion 55 wound about axis B and a pair of ends 56, 57. In particular, end 56 is connected to plate 22 of auxiliary pawl 21. End 57 engages slot 47 and is connected to protrusion 46.

The rotation about axis B of the auxiliary pawl 21 from the closing position to the opening position causes the eccentric rotation of pawl 40 about axis B subsequently along a first stroke and a second stroke, and, at the same time, the rotation of pawl 40 about axis D along an arch-shaped trajectory.

In greater detail, pawl 40 rotates about axis D along an arc-shaped trajectory—and therefore eccentrically about axis B—from an initial position (FIG. 2) towards an intermediate position along the first stroke, and from the intermediate position (FIG. 5) towards a final position (FIG. 6) along the second stroke. Pawl 40 cooperates with ratchet 20 in contact point P along the first stroke, so as to keep ratchet 20 in the closing position. Pawl 40 further leaves, along the second stroke, ratchet 20 free to move from the closing position towards the opening position. Still more precisely, pawl 40 rotates about axis D in the second rotation direction—anticlockwise in FIGS. 2 to 7—along the first stroke, and rotates about axis D in the first rotation direction—clockwise in FIGS. 2 to 7—along the second stroke.

Figure 1:
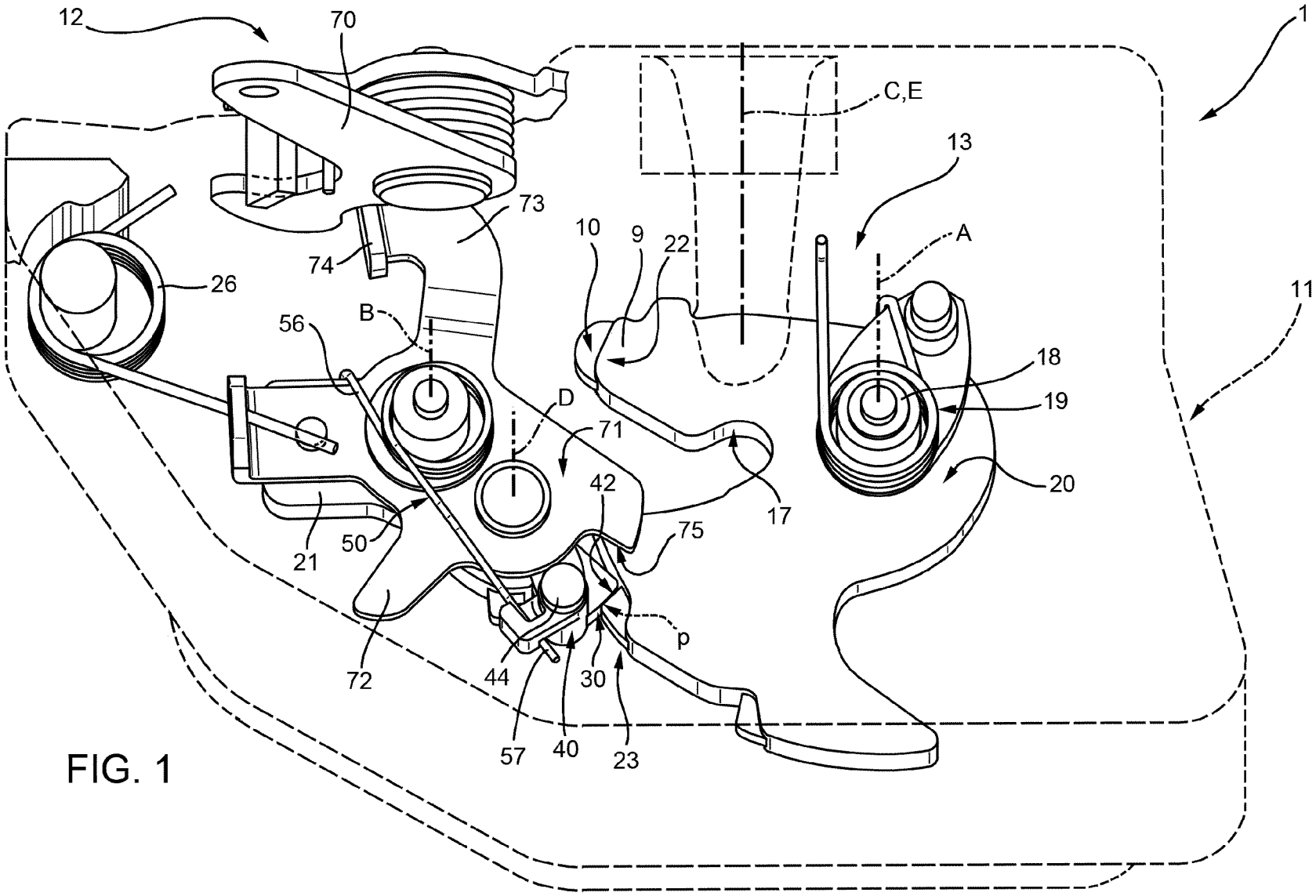
FIG. 1 is a perspective view of the latch for a door of a motor vehicle in accordance to the present invention.
Figure 2:
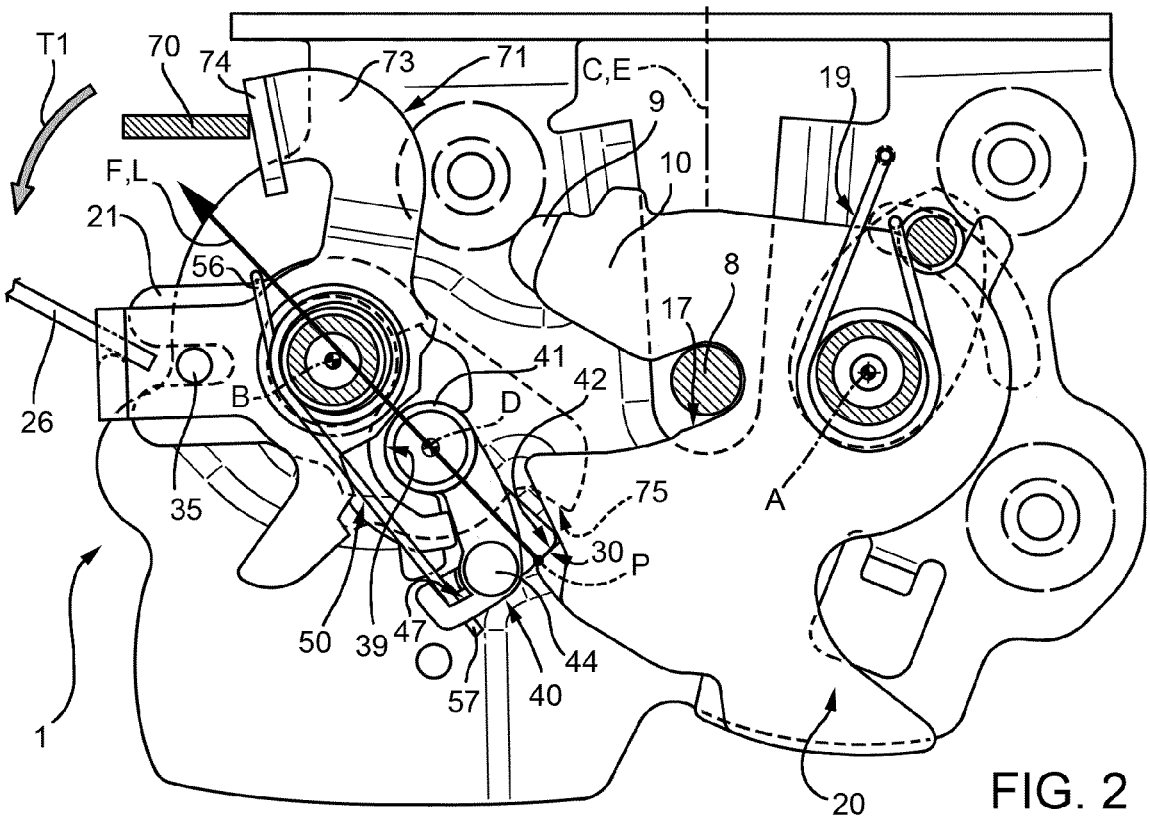
FIGS. 2 to 6 show the latch of FIG. 1 in respective operative positions and during subsequent steps of an opening operation of the door.
Figure 3:
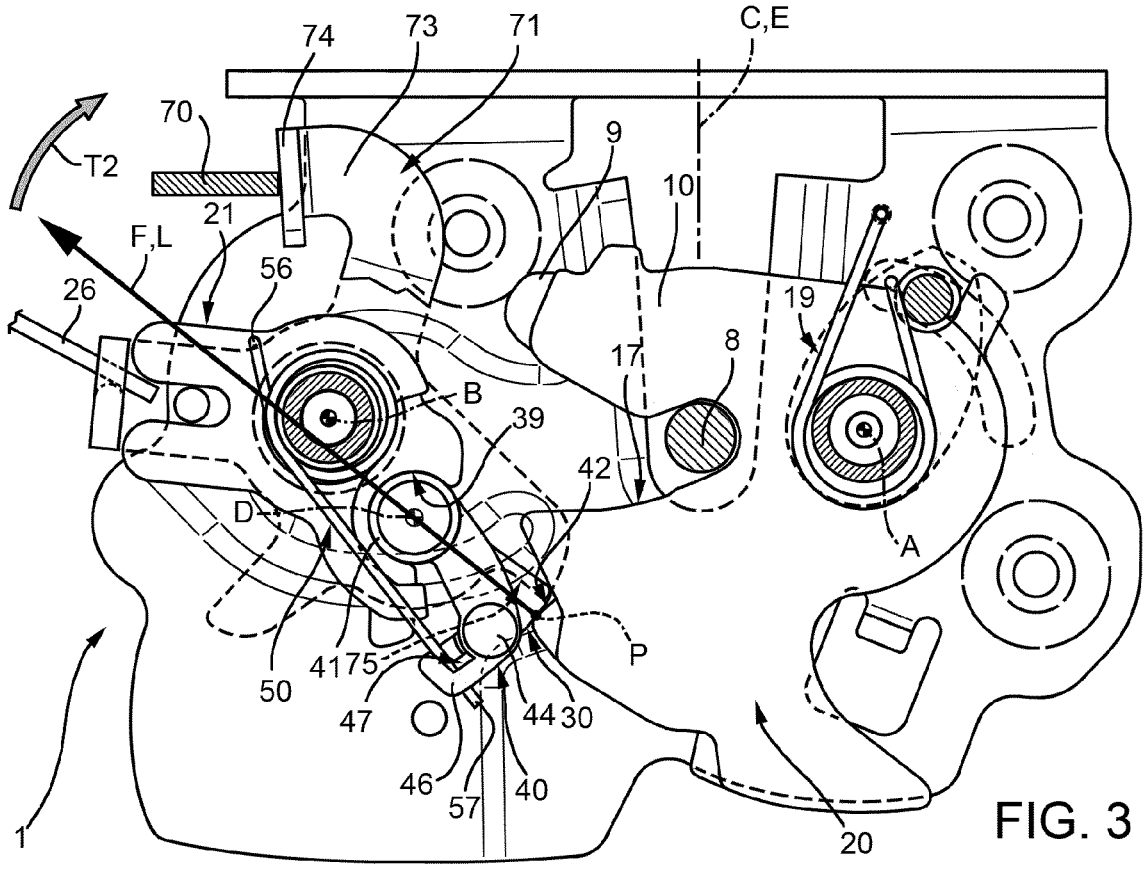

Contact point P and axis B are joined by a line L along which ratchet 20 exerts a force F onto the assembly made by auxiliary pawl 21 and pawl 40, along the first stroke of pawl 40. Still more precisely, when auxiliary pawl 21 is kept by spring 26 in the coupled position, pawl 40 is in the initial position (FIG. 2). In this condition, force F generates onto pawl 40, and therefore onto auxiliary pawl 21, a closing torque T1 directed in the second rotation direction (anticlockwise with reference to FIGS. 2 to 7). In this way, force F keeps auxiliary pawl 21 and pawl 40 in the closing position.

As pawl 40 continues to rotate eccentrically about axis B in the first rotation direction—clockwise with respect to FIGS. 2 to 6—under the action of opening mechanism 13, contact point P rotates in the same first rotation direction eccentrically about axis B and line L varies its position with respect to axis B. As a result, the distance of line L from axis B decreases, so as to reduce closing torque T1 on pawls 21, 40. When axis B lies on line L, the closing torque T1 is substantially null. The further rotation of auxiliary pawl 21 about axis B in the first rotation direction causes the further corresponding eccentric rotation of pawl 40 about axis B. As a result, contact point P rotates eccentrically about axis B, so that force F generates an opening torque T2, i.e. a torque directed in the first rotation direction, clockwise with reference to FIGS. 2 to 7.

Figure 4:
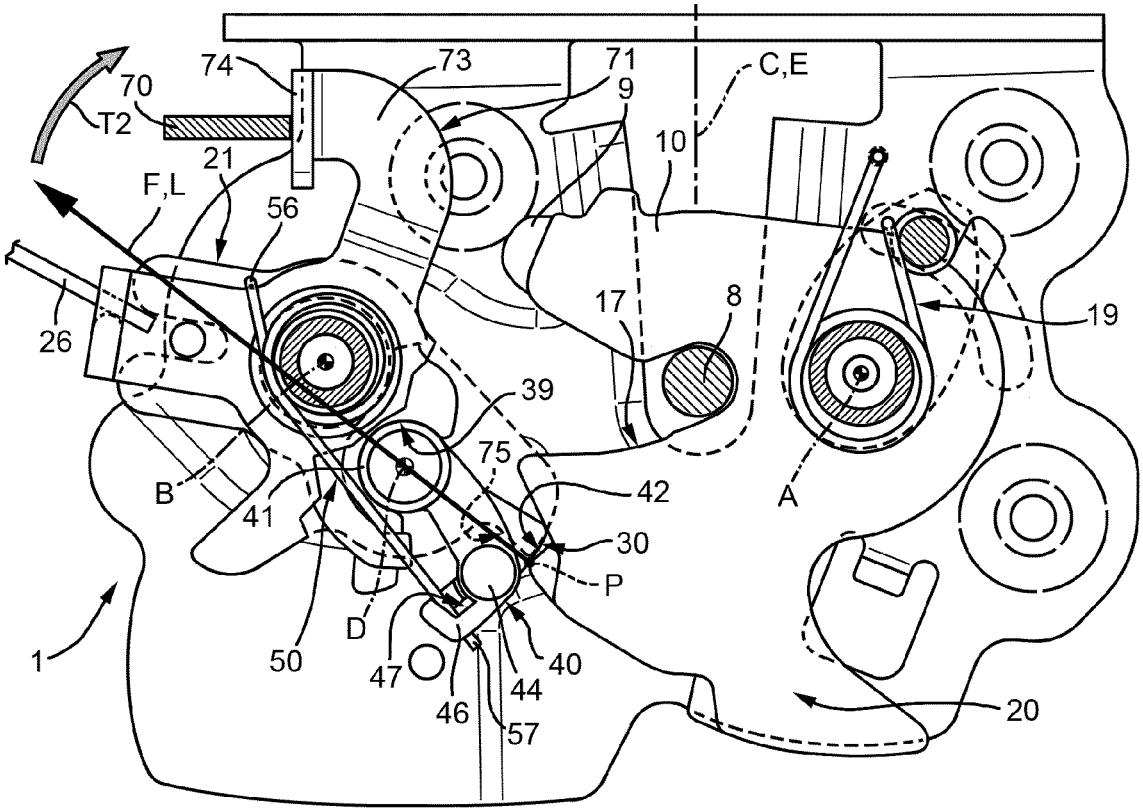

The further eccentric rotation of pawl 40 about axis B increases the distance between line L and axis B, so that opening torque T2 increases (FIGS. 4 to 6). Put another way, the eccentricity of line L with respect to axis B increases. In other words, the further rotation of pawl 40 generates opening torque T2 of increasing value onto pawls 21, 40. Along the second stroke, pawl 40 rotates about axis D in the first rotation direction and no longer contacts ratchet 20, which returns in the opening position under the action of spring 19 and torque exerted by seal 5.

Opening assembly 13 comprises: a lever 70 (FIG. 1), which is operatively connected either to a manually operated handle of door 2 or to an electrical motor, and which comprises an end 69 on the side of pawls 21, 40; and a lever 71 operated by lever 70 and operatively connected to auxiliary pawl 21 for moving it from the coupled position towards the decoupled position, and against the action of spring 26. In the embodiment shown, lever 70 rotates in a plane orthogonal to axis A, B, D and is arranged on the opposite side of lever 71, pawls 21, 40 and ratchet 20 with respect to plate 15.

Lever 71 substantially comprises: a body 72 hinged to plate 15 about axis B integrally to auxiliary pawl 21; an arm 73, which protrudes from body 72 towards lever 71 and defines an end abutting step 74; and an arm 75 which protrudes from body 72 on the opposite side of arm 73 and towards pawl 40 and defines an end abutting step 76. Step 74 upwardly protrudes from arm 73 and is adapted to receive an action from end 69 of lever 70. That action moves lever 71 and auxiliary pawl 21 integrally about axis B in the first rotation direction, clockwise in FIGS. 2 to 7. In this way, auxiliary pawl 21 move from the coupled position towards the decoupled position of auxiliary pawl 21. Step 76 downwardly protrudes from arm 75 and is adapted to contact abutting surface 45 of pin 44, so as to move auxiliary pawl 21 from the intermediate position in the final position, in case opening torque T2 generated by force F is not enough to move auxiliary pawl 21 in the decoupled position.

The operation of latch 1 is described in the following of the present description, starting from a configuration in which (FIG. 2) latch 1 locks door 2 to frame 4.

In this configuration, ratchet 20 is in the closing position, auxiliary pawl 21 is in the coupled position, pawl 40 in the initial position, and end 69 of lever 70 is detached from step 74 of lever 71. In greater detail, spring 26 loads auxiliary pawl 21 towards the coupled position. Furthermore, pawl 40 cooperates with tooth 23 and exerts on ratchet 20 a closing torque directed in the second rotation direction, anticlockwise with reference to FIGS. 2 to 6. That closing torque balances the action of spring 19 and force exerted by seal 5, thus keeping ratchet 20 in the closing position, in which striker 8 is blocked inside seat 17. In particular, surface 42 of pawl 40 contacts surface 30 of tooth 23 of ratchet 20 at contact point P.

Ratchet 20 exerts on the assembly made by pawls 21, 40 a force F along line L, which joins contact point P and axis D. Force F is offset with respect to axis B. More precisely, force F generates closing torque T1 (FIG. 2) on pawls 21, 40 with respect to axis B and directed in the second direction—anticlockwise in FIGS. 2 to 6. Therefore, in this configuration, closing torque T1 sums with the action of spring 26 and contributes to keep auxiliary pawl 21 in the coupled position and, therefore, ratchet 20 in the closing position.

When a manually operated handle of door 2 or an electrical motor is operated, lever 70 rotates up to a position in which end 69 contacts step 74 of lever 71 (FIG. 2). The rotation of lever 70 causes the rotation of lever 71, and, therefore, of the auxiliary pawl 21 about axis B in the first rotation direction, i.e. clockwise in FIGS. 2 to 7.

The rotation of auxiliary pawl 21 in the first rotation direction along an arch-shaped trajectory about axis B causes the eccentric rotation of pawl 40 in the first rotation direction about axis B and the rotation of pawl 40 in the second rotation direction about axis D and along an arc-shaped trajectory. This is due to the fact that portion 41 of pawl 40 engages seat 39 of auxiliary pawl 21 with rolling contact and substantially without any sliding contact.

In particular, pawl 40 moves along the first stroke (from FIGS. 2 to 5) from the initial position (FIG. 2) to the intermediate position (FIG. 5), and along the second stroke (from FIG. 5 to FIG. 6) from the intermediate position to the final position (FIG. 6). As pawl 40, along the first stroke, rotates eccentrically about axis B and along an arch-shaped trajectory about axis D, surface 42 and contact point P rotate about axis D and in the second rotation direction (see FIGS. 3 to 7) and along an arch-shaped trajectory.

It is important to point out that, due to the fact that surface 42 is shaped as a portion of cylindrical surface coaxial with axis D, surface 42 rolls on surface 30 substantially without sliding contact. As a result of the eccentric rotation of contact point P about axis B, line L varies its position with respect to axis B of auxiliary pawl 21. Still more precisely, the distance of line L from axis B decreases, so as to reduce closing torque T1 on pawls 21, 40. When axis B lies on line L, the closing torque T1 is substantially null.

The further eccentric rotation of auxiliary pawl 21 about axis B in the first rotation direction causes the further corresponding eccentric rotation of pawl 40 about axis B in the first direction, and about axis D and along an arch-shaped trajectory in the second direction. As a result, contact point P rotates, so that force F generates opening torque T2 (FIG. 3), i.e. a torque directed in the first rotation direction, clockwise with reference to FIGS. 2 to 7.

The further rotation of pawl 40 about axis D increases the distance between line L and axis B, so that opening torque T2 increases (FIGS. 4 and 5). In other words, the further rotation of pawl 40 generates opening torque T2 of increasing value onto pawls 21, 40. Still more precisely, the more pawl 40 eccentrically rotates in the first direction about axis D, the greater is opening torque T2. Opening torque T2 sums with action of lever 71 and thus contributes to thrust auxiliary pawl 21 towards the decoupled position against the action of spring 26.

Along the second stroke, pawl 40 rotates in the first rotation direction together with auxiliary pawl 21 about axis D, and surface 42 of pawl 40 moves beyond surface 30 of ratchet 20. As a result, ratchet 20 rotates in the second rotation direction—anticlockwise in FIGS. 2 to 6—under the action of spring 19 and seal 5, up to the opening position thereof. In particular, in the opening position of ratchet 20, seat 17 is not engaged by striker 8 and seat 17 is open parallel to direction C. As a result, striker 8 may leave seat 17, and door 2 can be arranged in the opening position.

In case elastic load exerted by seal 5 is not enough to spontaneously thrust ratchet 20 in the opening position, the rotation of lever 71 in the first direction causes the contact between step 76 and surface 45 of pin 44 of pawl 40. In this way, pawl 40 is moved away from tooth 23 of ratchet 20, which therefore returns in the opening position. This could occur, for example, when seal 5 is frozen or when latch 1 is on an assembly line and not yet mounted on door 2.

The advantages of latch 1 according to the present invention will be clear from the foregoing description.

In particular, pawl 40 eccentrically rotates about axis D with respect to auxiliary pawl 21, which rotates about axis B. In this way, contact point P rotates along an arc-shaped trajectory about axis D, when auxiliary pawl 21 rotates about axis about axis B. Accordingly, contact point P rotates eccentrically about axis B, thus varying the position of line L relative to axis B, when pawl 40 moves along the first stroke. In this way, force F, on one hand, generates closing torque T1 in the second rotation direction on auxiliary pawl 21 and pawl 40, when the latter is in the initial position (FIG. 2).

On the other hand, force F generates opening torque T2 in the first rotation direction, when pawl 40 is in the intermediate position (FIG. 5). In other words, pawl 40 efficiently contribute both to keep pawl 21 in the coupled position when ratchet 20 must be kept in the closing position, and to move pawl 21 in the decoupled position when ratchet 20 must be moved in the opening position.

Thanks to the fact that opening torque T2 gradually increases when pawl 40 approaches the intermediate position (FIGS. 3 to 5), the transition of ratchet 20 from the closing position to the opening position is smooth and slowed down. This is due to the fact that the eccentricity of force F with respect to axis B increases during the second stroke of pawl 40. As a result, the release of striker 8 substantially does not generate any unpleasant noise. Furthermore, seat 39 of auxiliary pawl 21 and portion 41 of pawl 40 roll one over the other, with substantial no sliding contact.

In this way, latch 20 allows to dramatically reduce the energy necessary to the move pawl 21 from the coupled position towards the decoupled position and, therefore, for moving ratchet 20 from the closing position to the opening position.

As a result, either the user is required to exert a lower force on the handle of the door or the electric motor may be made less cumbersome and lighter than in known solution discussed in the introductory part of the present description.

Finally, in case the elastic load exerted by seal 5 is not enough to spontaneously thrust ratchet 20 in the opening position, step 76 of lever 71 contacts surface 45 of pin 44 of pawl 40. In this way, pawl 40 is moved away from tooth 23 of ratchet 20, which can therefore return in the opening position. This is helpful for opening latch 1 also when seal 5 is frozen or when latch 1 is on an assembly line and not yet mounted on door 2.

Clearly, changes may be made to latch 1 as described and illustrated herein without, however, departing from the scope defined in the accompanying claims. In particular, pawl 40 could be hinged to auxiliary pawl 21 about axis D.

The invention claimed is:

1. A latch for a door of motor vehicle having a closing assembly adapted to cooperate with a latch striker, the latch comprising:

a ratchet moveable between an opening position in which said ratchet enables engagement and disengagement between the latch striker and a ratchet seat of said ratchet, and a closing position in which said ratchet holds the latch striker within said ratchet seat;

a first pawl rotatable about a first axis (B) in a first rotation direction from a coupled position in which it keeps said ratchet in said closing position and prevents disengagement of the latch striker from said ratchet seat, and a decoupled position in which it permits the movement of said ratchet from said closing position to said opening position; and a second pawl which cooperates with said first pawl, cooperates with said ratchet at least in a contact point (P) at least when said ratchet is in said closing position, and which is rotatable about a second axis (D) distinct from said first axis (B) so that said second pawl rotates eccentrically with respect to said first axis (B), said second pawl being rotatable about said second axis (D) from an initial position towards an intermediate position along a first stroke and from said intermediate position towards a final position along a second stroke, said second pawl cooperating with said ratchet at least in said contact point (P) along said first stroke so as to keep said ratchet in said closing position, said second pawl acting along said second stroke to leave said ratchet free to move from said closing position towards said opening position, said contact point (P) and said second axis (D) being joined by a line (L) along which said ratchet exerts a force (F) onto said second pawl along said first stroke, said line (L) being arranged relative to said first axis (B) in such a position that said force (F) generates an opening torque (T2) on said first pawl that is directed in said first rotation direction when said second pawl is in said intermediate position; and a control lever configured to be operated by an actuator and movable along an opening stroke which cooperates with said first pawl and moves said first pawl from said coupled position to said decoupled position, and wherein said opening stroke comprises a first stretch in which said control lever is decoupled from said second pawl and a second stretch in which said control lever is coupled with said second pawl and thrusts the latter towards said decoupled position;

wherein a minimum distance of said line (L) from said first axis (B) increases along an end portion of said first stroke so that said force (F) exerted onto said first pawl generates an increasing opening torque (T2) directed in said first rotation direction when said second pawl approaches said intermediate position; and wherein said first pawl defines an open pawl seat which is engaged by rotating contact by a pin carried by said second pawl, said pin being rotatable about said second axis (D) with respect to said pawl seat.

2. The latch of claim 1, wherein said line (L) is located in a position when said first pawl is in said initial position such that said force (F) generates a closing torque (T1) on said first pawl directed in a second rotation direction, opposite to said first rotation direction.

3. The latch of claim 1, wherein said first pawl and said second pawl rotate relative to one another about said second axis (D) in such a way that the rotation of said first pawl about said first axis (B) causes a rotation of said second pawl about said second axis (D).

4. The latch of claim 1, wherein said second pawl is rotatable about said second axis (D) in a first rotation direction along said first stroke, and wherein said second pawl is rotatable about said second axis (D) in a second rotation direction, opposite to said first rotation direction, along said second stroke.

5. The latch of claim 1, further comprising elastic means interposed between said first pawl and said second pawl.

6. The latch of claim 5, wherein said elastic means comprises a spring wound about said first axis (B) and having opposite ends connected to said first pawl and said second pawl.

7. The latch of claim 1, wherein said second pawl includes a first surface which rolls on a second surface of said ratchet when the latter is in said closing position, and wherein said first surface is shaped as a portion of a cylindrical surface which is coaxial with said second axis (D).

8. The latch of claim 1, wherein said second pawl includes a main body lying on a plane transverse to said second axis (B), wherein said main body defines said first surface and said pin, wherein said main body includes an appendix protruding from said body, and wherein said control lever contacts said appendix along said second stretch of said stroke.

9. A latch for a door of motor vehicle having a closing assembly adapted to cooperate with a latch striker, the latch comprising:

a ratchet operable in an opening position in which said ratchet enables engagement and disengagement between the latch striker and a ratchet seat of said ratchet, and a closing position in which said ratchet holds the latch striker within said ratchet seat;

a first pawl rotatable about a first axis (B) in a first rotation direction from a coupled position in which it keeps said ratchet in said closing position and prevents disengagement of the latch striker from said ratchet seat, and a decoupled position in which it permits the movement of said ratchet from said closing position to said opening position; and a second pawl which cooperates with said first pawl, cooperates with said ratchet at least in a contact point (P) at least when said ratchet is in said closing position, and which is rotatable about a second axis (D) distinct from said first axis (B) so that said second pawl may eccentrically rotate with respect to said first axis (B), wherein said second pawl includes a first surface which rolls on a second surface of said ratchet when the latter is in said closing position, and wherein said first surface is shaped as a portion of a cylindrical surface which is coaxial with said second axis (D); and a control lever movable along an opening stroke which cooperates with said first pawl and moves said first pawl from said coupled position to said decoupled position, and wherein said opening stroke comprises a first stretch in which said control lever is decoupled from said second pawl and a second stretch in which said control lever is coupled with said second pawl and thrusts the latter towards said decoupled position;

wherein said first pawl defines an open pawl seat which is engaged by a pin carried by the second pawl, said pin being rotatable about said second axis (D) with respect to said pawl seat.

10. The latch of claim 9, wherein said second pawl is rotatable about said second axis from an initial position towards an intermediate position along a first stroke and from said intermediate position towards a final position along a second stroke, said second pawl cooperating with said ratchet at least in said contact point (P) along said first stroke so as to hold said ratchet in said closing position, said second pawl acting along said second stroke to leave said ratchet free to move from said closing position toward said opening position, wherein said contact point (P) and said second axis (D) being joined by a line (L) along which said ratchet exerts a force (F) on said second pawl along said first stroke, said line (L) being arranged relative to said first axis (B) such that said force (F) generates an opening torque (T2) on said first pawl that is directed in said first rotational direction when said second pawl is located in said intermediate position.

11. The latch of claim 10, wherein said line (L) is located in a position when said first pawl is in said initial position such that said force (F) generates a closing torque (T1) on said first pawl directed in a second rotation direction, opposite to said first rotation direction.

12. The latch of claim 9, wherein said first pawl and said second pawl rotate relative to one another about said second axis (D) in such a way that the rotation of said first pawl about said first axis (B) causes a rotation of said second pawl about said second axis (D).

13. The latch of claim 9, wherein said second pawl includes a main body lying on a plane transverse to said second axis (B), wherein said main body defines said first surface and said pin, wherein said main body includes an appendix protruding from said body, and wherein said control lever contacts said appendix along said second stretch of said stroke.

14. A latch for a door of motor vehicle having a closing assembly adapted to cooperate with a latch striker, the latch comprising:

a ratchet moveable between an opening position in which said ratchet enables engagement and disengagement between the latch striker and a ratchet seat of said ratchet, and a closing position in which said ratchet holds the latch striker within said ratchet seat;

a first pawl rotatable about a first axis (B) in a first rotation direction from a coupled position in which it keeps said ratchet in said closing position and prevents disengagement of the latch striker from said ratchet seat, and a decoupled position in which it permits the movement of said ratchet from said closing position to said opening position;

a second pawl which cooperates with said first pawl, cooperates with said ratchet at least in a contact point (P) at least when said ratchet is in said closing position, and which is rotatable about a second axis (D) distinct from said first axis (B) so that said second pawl rotates eccentrically with respect to said first axis (B), said second pawl being rotatable about said second axis (D) from an initial position towards an intermediate position along a first stroke and from said intermediate position towards a final position along a second stroke, said second pawl cooperating with said ratchet at least in said contact point (P) along said first stroke so as to keep said ratchet in said closing position, said second pawl acting along said second stroke to leave said ratchet free to move from said closing position towards said opening position, said contact point (P) and said second axis (D) being joined by a line (L) along which said ratchet exerts a force (F) onto said second pawl along said first stroke, said line (L) being arranged relative to said first axis (B) in such a position that said force (F) generates an opening torque (T2) on said first pawl that is directed in said first rotation direction when said second pawl is in said intermediate position, wherein a minimum distance of said line (L) from said first axis (B) increases along an end portion of said first stroke so that said force (F) exerted onto said first pawl generates an increasing opening torque (T2) directed in said first rotation direction when said second pawl approaches said intermediate position; and a control lever operable by an actuator and movable along an opening stroke which cooperates with said first pawl and moves said first pawl from said coupled position to said decoupled position, and wherein said opening stroke comprises a first stretch in which said control lever is decoupled from said second pawl and a second stretch in which said control lever is coupled with said second pawl and thrusts the latter towards said decoupled position;

wherein said first pawl defines an open pawl seat which is engaged by a pin carried by said second pawl, said pin being rotatable about said second axis (D) with respect to said pawl seat.

15. The latch of claim 14, wherein said second pawl includes a main body lying on a plane transverse to said second axis (B), wherein said main body defines said first surface and said pin, wherein said main body includes an appendix protruding from said body, and wherein said control lever contacts said appendix along said second stretch of said stroke.

16. The latch of claim 14, wherein said line (L) is located in a position when said first pawl is in said initial position such that said force (F) generates a closing torque (T1) on said first pawl directed in a second rotation direction, opposite to said first rotation direction.

* * * * *